US010797453B2

(12) United States Patent
Wang et al.

(10) Patent No.: US 10,797,453 B2
(45) Date of Patent: Oct. 6, 2020

(54) MULTI-SPECIFICATION PLUG ADAPTER

(71) Applicants: Ming Tsai Wang, DongGuan (CN); Jeng Je Pan, DongGuan (CN); Chi Chiu, DongGuan (CN)

(72) Inventors: Ming Tsai Wang, DongGuan (CN); Jeng Je Pan, DongGuan (CN); Chi Chiu, DongGuan (CN)

(73) Assignee: DongGuan AHOKU Techland Electronics Ltd., DongGuan, GuangDong (CN)

( * ) Notice: Subject to any disclaimer, the term of this patent is extended or adjusted under 35 U.S.C. 154(b) by 0 days.

(21) Appl. No.: 16/293,534

(22) Filed: Mar. 5, 2019

(65) Prior Publication Data

US 2020/0287338 A1 Sep. 10, 2020

(51) Int. Cl.

| | |
|---|---|
| ***H01R 31/06*** | (2006.01) |
| ***H01R 35/04*** | (2006.01) |
| ***H01R 13/52*** | (2006.01) |
| ***H01R 13/502*** | (2006.01) |

(52) U.S. Cl.

CPC ..... *H01R 31/06* (2013.01); *H01R 13/502* (2013.01); *H01R 13/5213* (2013.01); *H01R 35/04* (2013.01)

(58) Field of Classification Search

CPC .. H01R 31/06; H01R 13/502; H01R 13/5213; H01R 35/04

USPC ..... 439/13, 131, 172, 173

See application file for complete search history.

(56) References Cited

U.S. PATENT DOCUMENTS 4,997,381 A * 3/1991 Oh ..... H01R 27/00 439/131
5,159,545 A * 10/1992 Lee ..... H01R 31/065 363/146
5,611,701 A * 3/1997 Hahn ..... H01R 24/66 439/131
5,634,806 A * 6/1997 Hahn ..... H01R 27/00 439/172
5,791,921 A * 8/1998 Lee ..... H01R 27/00 439/103
5,906,509 A * 5/1999 Wu ..... H01R 29/00 439/518
5,967,807 A * 10/1999 Wu ..... H01R 29/00 439/131
6,109,977 A * 8/2000 Baxter ..... H01R 13/04 439/171
6,126,460 A * 10/2000 Wu ..... H01R 27/00 439/131
6,659,782 B2 * 12/2003 Wu ..... H01R 31/065 439/131

(Continued)

*Primary Examiner* — Peter G Leigh

(57) ABSTRACT

A multi-specification plug adapter, the multi-specification plug adapter comprises a first outer casing and a second outer casing assembled with each other. The second outer casing is provided with one or more than one socket hole; one or more than one slideable plug is located in the first outer casing. The plug is provided with a push button. The push button is located outside the first outer casing. The first plug pins or the second plug pins of the plug can be extended out of the first outer casing by pushing the push button. One set of or more than one set of corresponding shaft and shaft hole is located between the second outer casing and the first outer casing, the first outer casing can rotate against the second outer casing on the shaft.

6 Claims, 6 Drawing Sheets

(56) References Cited

U.S. PATENT DOCUMENTS

| | | | | |
|---|---|---|---|---|
| 6,935,878 | B2 * | 8/2005 | Hsu | H01R 13/44 439/171 |
| 7,052,298 | B1 * | 5/2006 | Cheng | H01R 13/6675 439/103 |
| 7,354,286 | B1 * | 4/2008 | Lee | H01R 13/652 439/131 |
| 7,438,574 | B2 * | 10/2008 | Neumann | H01R 13/4532 439/172 |
| 7,465,176 | B2 * | 12/2008 | Liao | H01R 27/00 439/172 |
| 7,549,877 | B1 * | 6/2009 | Vista, Jr. | H01R 13/6675 439/172 |
| 7,614,892 | B2 * | 11/2009 | Klant | H01R 31/06 439/172 |
| 7,632,119 | B1 * | 12/2009 | Ma | H01R 31/06 439/172 |
| 8,491,317 | B2 * | 7/2013 | Vardanyan | H01R 27/00 363/142 |
| 8,734,168 | B2 * | 5/2014 | Lee | H01R 31/06 439/171 |
| 8,936,478 | B2 * | 1/2015 | Choi | H01R 13/447 439/172 |
| 9,166,351 | B1 * | 10/2015 | Wang | H01R 27/00 |
| 9,520,723 | B2 * | 12/2016 | Weaver, Jr. | H01R 13/6675 |
| 2002/0081906 | A1 * | 6/2002 | Kajiwara | H01R 31/065 439/651 |
| 2004/0097114 | A1 * | 5/2004 | Shiroshita | H01R 31/06 439/174 |

* cited by examiner

MULTI-SPECIFICATION PLUG ADAPTER

BACKGROUND OF INVENTION

1. Field of the Invention

The present invention relates generally to the technical field of plug adapter products, and more particularly to a multi-specification plug adapter.

2. Description of Related Art

With increasingly close international exchanges, various countries use each other's electronic products increasingly, if the foreign electronic products are bought home, or the mobile phones, digital cameras and notebook computers are carried abroad, the plugs of electronic products are fixed at a standard form, whereas the socket standards are different in different countries. In order not to influence the use of these electronic products in different countries, people use plug adapters to solve this problem.

The plug adapter means one product has the plugs of multiple specifications at the same time, so it can be adapted to the plugs of different specifications in multiple countries. However, one plug adapter has to hold multiple pins of different specifications, so the volume of the whole plug adapter is larger than the volume of one plug, and it is inserted and used directly, it cannot be rotated to change the angle, it is not so convenient.

In view of this, this inventor proposes the following technical proposal.

SUMMARY OF THE INVENTION

The purpose of the present invention is to overcome the deficiencies in the existing technology to provide a multi-specification plug adapter.

In order to solve the above problems, the technical scheme of the present invention is described below:

A multi-specification plug adapter, comprising a first outer casing and a second outer casing mounted to each other; the second outer casing including one or more than one outlets; the first outer casing including one or more than one sliding plugs disposed therein; the plug is provided with a push button, and the push button is disposed outside the first outer casing; the plug having first plug pins and second plug pins of different specifications at both ends; the first plug pins or the second plug pins of the plug can be extended outside the first outer casing by pushing the push button; wherein the second outer casing and the first outer casing have one or more sets of corresponding rotating shafts and shaft holes; the first outer casing is rotatable relative to the second outer casing through the rotating shaft.

More particularly, wherein the second outer casing is formed with an extension arm on both sides; the extension arm is formed with the shaft or the shaft hole.

More particularly, wherein the second outer casing includes second bus bars electrically connected to conductive sheets in the outlet; the first outer casing includes first bus bars electrically connected to the plug; the second bus bars and the first bus bars are electrically conducted through the shaft. More particularly, the end of the second outer casing includes a first holding slot for holding the first plug pins or the second plug pins.

More particularly, wherein the second housing includes the corresponding first holding slot at the end for accepting the first plug pins or the second plug pins.

More particularly, wherein the first outer casing includes a removable grounding pin from the slot on the outer surface; the first outer casing further includes a plug-in mounting hole for detaching the grounding pin on the outer surface.

More particularly, wherein the second bus bars connected to the conductive sheet are connected to the varistor or the gas discharge tube, or the first bus bars connected to the plug is connected to varistor or gas discharge tube.

More particularly, wherein the second outer casing includes a power conversion module and a DC outlet.

More particularly, wherein the first outer casing includes slidable inclined shutters and accesses at the end, the slidable inclined shutters are built in the accesses inside, when pushing out the first plug pins or the second plug pins, the slidable inclined shutter is pushed by plug pin.

Compared with the prior art, the invention has the following benefits: One set of or more than one set of corresponding shaft and shaft hole is located between the second outer casing and the first outer casing. The first outer casing can rotate against the second outer casing on the shaft, which is to say, in specific use of the present invention, when the first plug pins or the second plug pins of plug are extended out of the first outer casing by pushing the push button, the first outer casing is turned 90° against the second outer casing, so that the first plug pins or the second plug pins in the first outer casing 1 can be inserted in the external socket, the plug can be used by turning the first outer casing to change angle, it is convenient to use, and the present invention is smaller and flatter to be carried with and used.

DETAILED DESCRIPTION OF THE INVENTION

Figure 1:
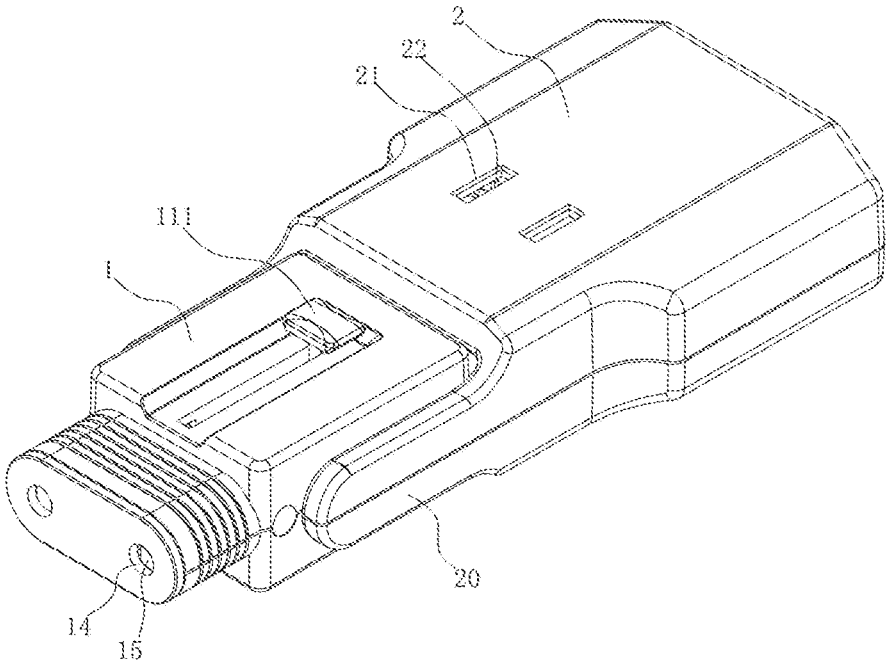
FIG. 1 is the stereogram of Embodiment 1 of the present invention.
Figure 2:
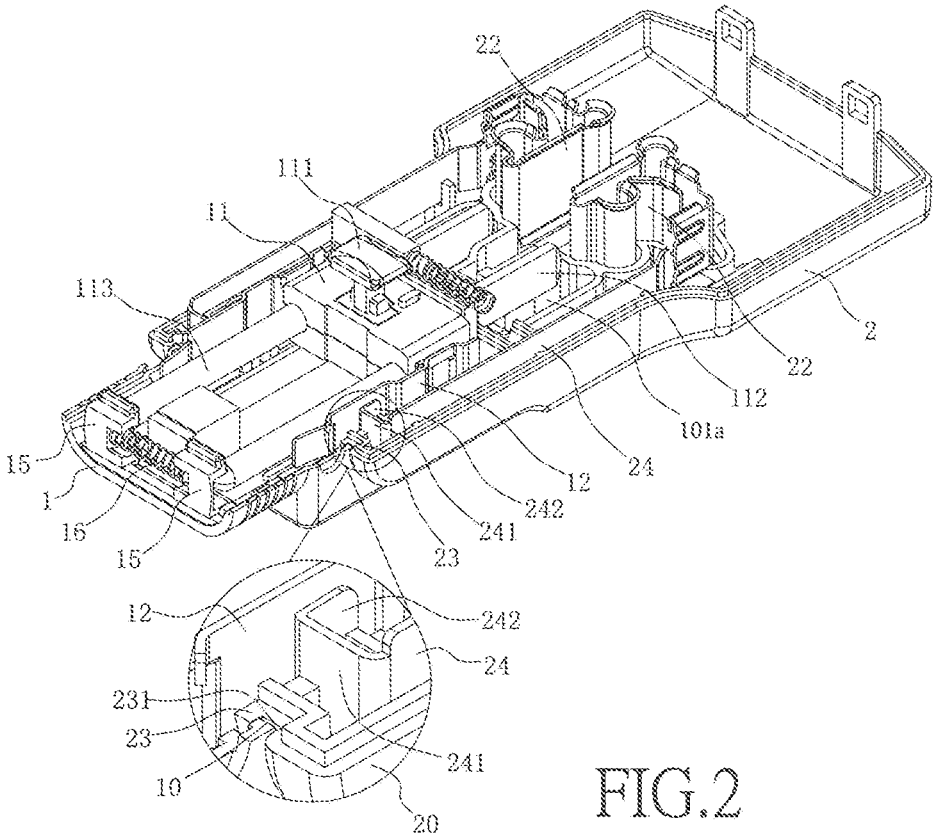
FIG. 2 is the internal structure diagram of Embodiment 1 of the present invention.
Figure 3:
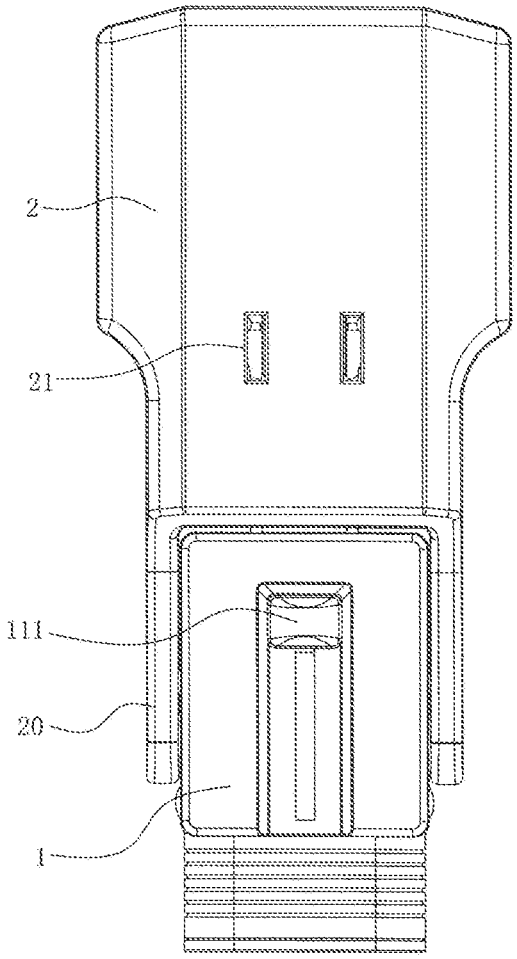
FIG. 3 is a front view of Embodiment 1 of the present invention.
Figure 4:
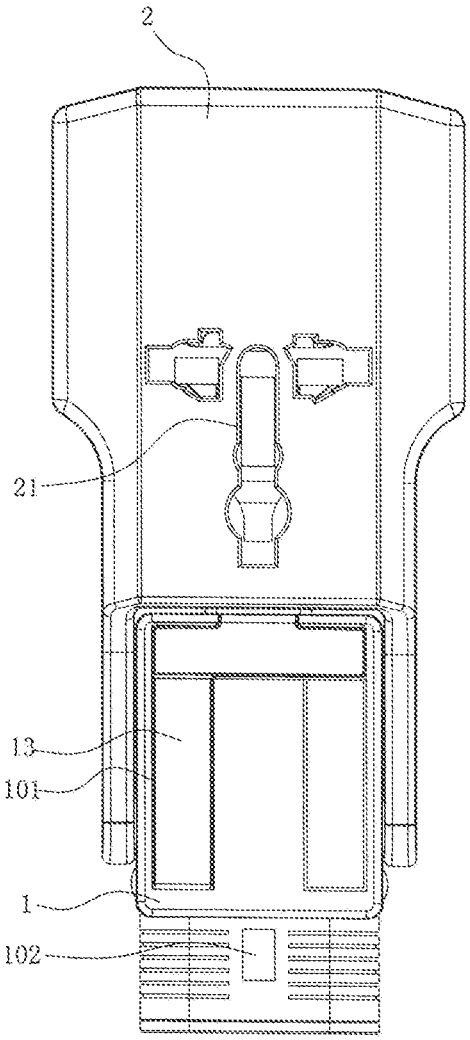
FIG. 4 is a rear view of Embodiment 1 of the present invention.

Described with attached figures below.

FIGS. 1-8 show a multi-specification plug adapter, comprising a first outer casing 1 and a second outer casing 2 mounted to each other, the first outer casing 1 and the second outer casing 2 are flat.

The second outer casing 2 is provided with one or more than one outlets 21 and a conductive sheet 22 exposed in the socket hole. In this embodiment, there are two sets of the outlets 21, which are located in the upper end face and lower end face of the second outer casing 2 respectively, and the conductive sheet 22 is located in each set of outlets 21, so as to form electrical conduction after an external plug is inserted in.

One or more than one slideable plug 11 electrically connected to the conductive sheet 22 is located in the first outer casing 1. The plug 11 is provided with a push button 111. The push button 111 is located outside the first outer casing 1. The first plug pins 112 and the second plug pins 113 of different specifications are located in both ends of the plug 11. The first plug pins 112 or the second plug pins 113 of plug 11 can be extended out of the first outer casing 1 by pushing the push button 111; which is to say, to use the first plug pins 112 of the first specification, the plug 11 can be slid in the first outer casing 1 by pushing the push button 111, and the first plug pins 112 can be extended out of the first outer casing 1; to use the second plug pins 113 of the other specification, the plug 11 can be slid in the first outer casing 1 by pushing the push button 111, and the second plug pins 113 can be extended out of the first outer casing 1, so that the first plug pins 112 or the second plug pins 113 can be selected according to actual requirement.

The first outer casing 1 includes a removable grounding wire pin 13 from the slot on the outer surface. To be specific, the external surface of the first outer casing 1 includes a holding groove 101, the grounding pin 13 is clamped in the holding groove 101. Wherein the grounding pin 13 is L-shaped, and the holding groove 101 is also L-shaped. The grounding pin 13 can be British grounding pin.

The external surface of the first outer casing 1 is provided with a plug-in mounting hole 102 for mounting/dismounting the grounding pin 13. To be specific, there can be two plug-in mounting holes, which are located in the front and back surfaces of the first outer casing 1. In the use of it, the grounding pin 13 is pulled out against the first outer casing 1, and one end of the grounding pin 13 is inserted in the plug-in mounting hole 102, so that the grounding pin 13 can be inserted in a British socket with the first plug pins 112 or the second plug pins 113.

Wherein the second housing 2 includes a corresponding first holding slot 101*a* at the end for accepting the first plug pins 112 or the second plug pins 113. When the adapter is not used, the first plug pins 112 or the second plug pins 113 of plug 11 can be extended out of the first outer casing 1 and inserted in the first holding slot 101*a* by pushing the push button 111 on the first outer casing 1, and the second plug pins 113 or the first plug pins 112 are stored in the first outer casing 1. Which is to say, when the first plug pins 112 are extended out of the first outer casing 1 and inserted in the first holding slot 101*a*, the second plug pins 113 are stored in the first outer casing 1. On the contrary, when the second plug pins 113 are extended out of the first outer casing 1 and inserted in the first holding slot 101*a*, the first plug pins 112 are stored in the first outer casing 1, so that the first outer casing 1 and the second outer casing 2 are connected firmly, and the first outer casing 1 can be prevented from rotating against the second outer casing 2, facilitating storage or carrying.

One set of or more than one set of corresponding shaft 23 and shaft hole 10 is located between the second outer casing 2 and the first outer casing 1. The first outer casing 1 can rotate against the second outer casing 2 on the shaft 23, which is to say, in specific use of the present invention, when the first plug pins 112 or the second plug pins 113 of plug 11 are extended out of the first outer casing 1 by pushing the push button 111, the first outer casing 1 is turned 90° against the second outer casing 2, so that the first plug pins 112 or the second plug pins 113 in the first outer casing 1 can be inserted in the external socket, the plug can be used by turning the first outer casing to change angle, it is convenient to use, and the present invention is smaller and flatter to be carried with and used.

To be specific, an extension arm 20 is formed on both sides of the end of the second outer casing 2. The shaft 23 is formed on the inner side of the extension arm 20. A slot 231 is formed outside the shaft 23. The shaft hole 10 is located in the sidewall of the first outer casing 1. When the shaft 23 passes through the shaft hole 10, the hole wall edge of the shaft hole 10 is stuck in the slot 231 outside shaft 23, so that the shaft 23 is fixed into the shaft hole 10 of the first outer casing 1, the structure is very stable, the shaft 23 can rotate in shaft hole 10 stably, and the first outer casing 1 can rotate against the second outer casing 2 stably.

The second outer casing 2 includes second bus bars 24 electrically connected to conductive sheets 22 in the outlet; the first outer casing 1 includes first bus bars 12 electrically connected to the plug 11; the second bus bars 24 and the first bus bars 12 are electrically conducted through the shaft 23. In this embodiment, the end of the second bus bar 24 is conductively connected to the first bus bar 12 through the shaft 23. To be specific, the end of the second bus bar 24 is bent to form a first bent part 241. An elastic conduction part 242 is formed at the end of the first bent part 241. The first bent part 241 passes through shaft 23, and the elastic conduction part 242 contacts the second bus bar 24 elastically, so as to guarantee the stability of conductive connection.

The first bus bar 12 is connected to varistor or gas discharge tube, or the second bus bar 24 is connected to varistor or gas discharge tube.

the second outer casing 2 includes a power conversion module and a DC outlet.

Wherein the first outer casing 1 includes slidable inclined shutters 15 and accesses 14 at the end, the slidable inclined shutters 15 are built in the accesses 14 inside, when pushing out the first plug pins 112 or the second plug pins 113, the slidable inclined shutter 15 is pushed by plug pin. Wherein the slidable inclined shutters 15 are connected to spring 16 or rebound leaf. The slidable inclined shutters 15 block off the accesses 14 with the elastic force of the spring 16 or rebound leaf, so as to protect the first plug pins 112 or the second plug pins 113 better, and to prevent dust.

Figure 5:
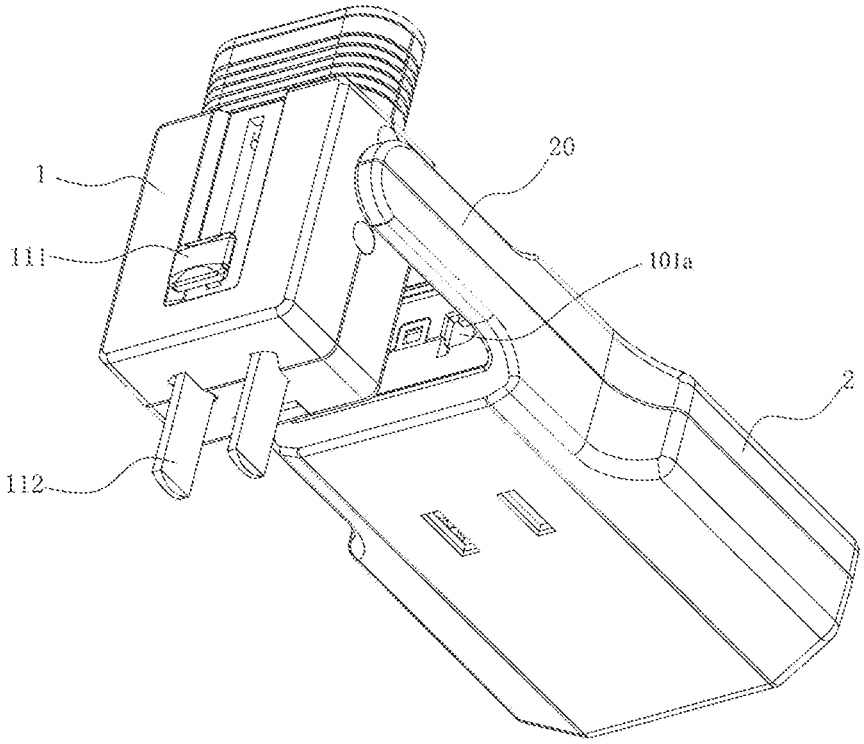
FIG. 5 is a first user mode diagram of Embodiment 1 of the present invention.

The present invention has the following usage modes:

Mode 1: according to FIG. 5, when the present invention is to use the first plug pins 112 of the first specification, the push button 111 can be pushed to slide the plug 11 in the first outer casing 1, and the first plug pins 112 are extended out of the first outer casing 1. The first outer casing 1 is turned 90° against the second outer casing 2, so that the first plug pins 112 in the first outer casing 1 are inserted in the external socket, the plug can be used by turning the first outer casing to change angle, it is very convenient.

Figure 6:
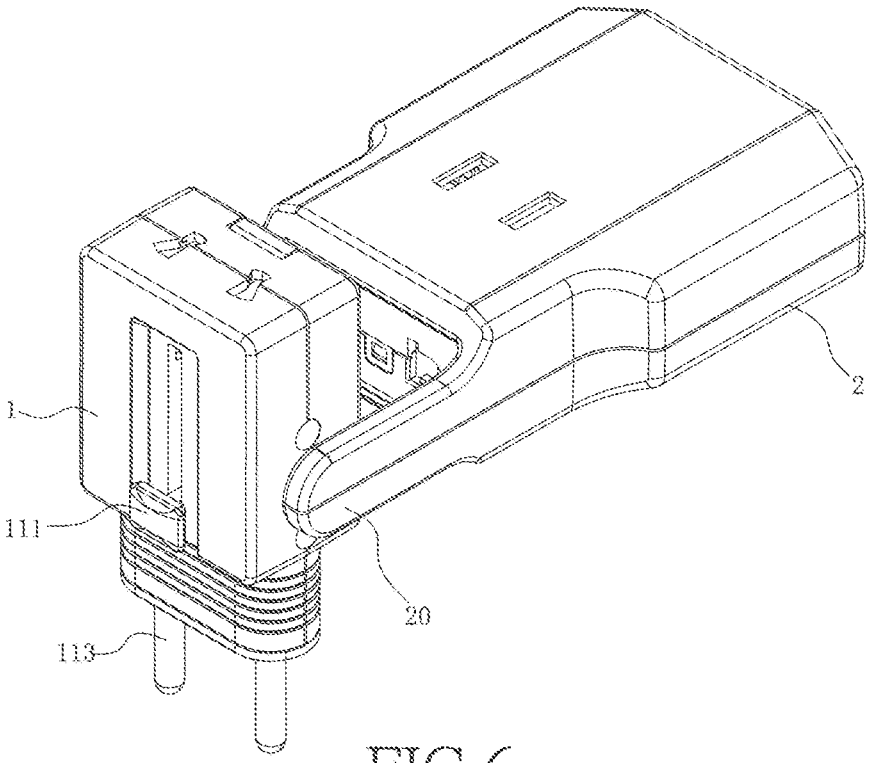
FIG. 6 is a second user mode diagram of Embodiment 1 of the present invention.

Mode 2: according to FIG. 6, when the present invention is to use the second plug pins 113 of the first specification, the push button 111 can be pushed to slide the plug 11 in the first outer casing 1, and the second plug pins 113 are extended out of the first outer casing 1; and then the first outer casing 1 is turned 90° against the second outer casing 2, so that the second plug pins 113 in the first outer casing 1 can be inserted in the external socket, the plug can be used by turning the first outer casing to change angle, it is very convenient.

Figure 7:
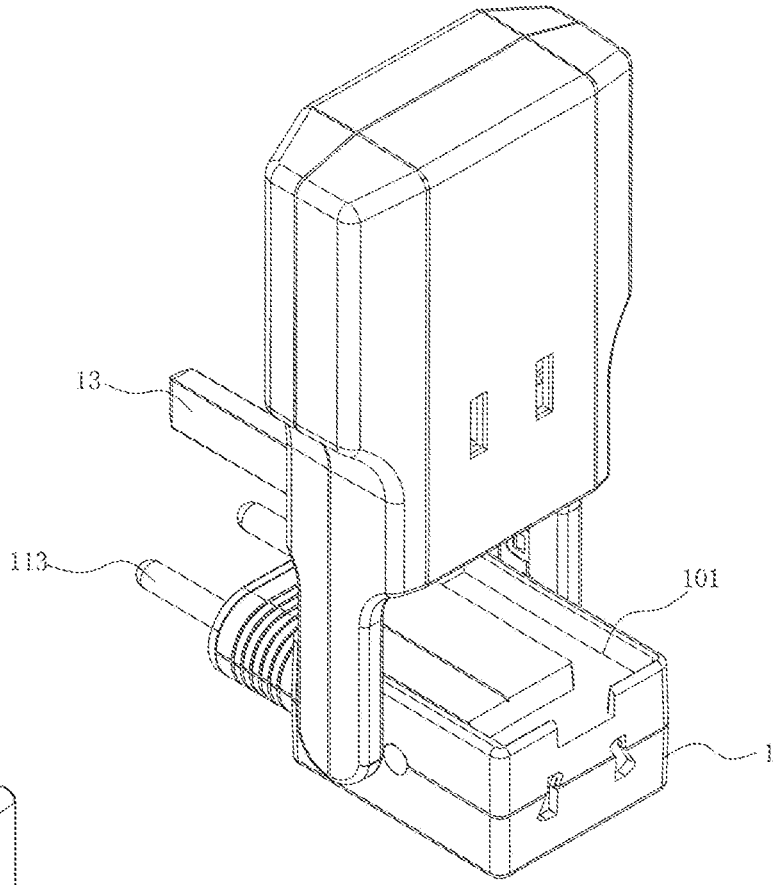
FIG. 7 is a third user mode diagram of Embodiment 1 of the present invention.
Figure 8:
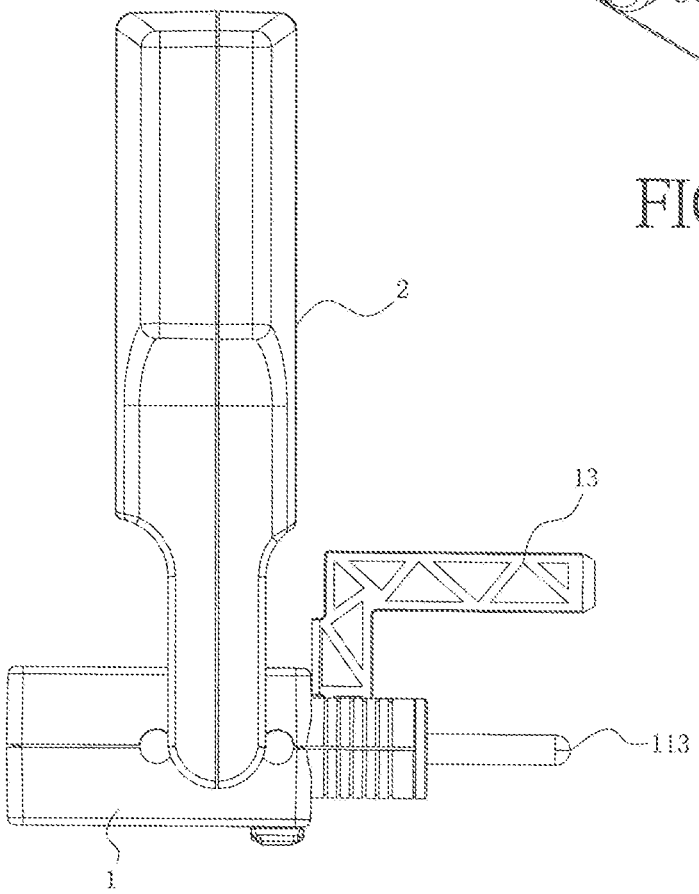
FIG. 8 is a front view of FIG. 7.

Mode 3: according to FIGS. 7 and 8, based on the second usage mode, the grounding pin 13 can be pulled out against the first outer casing 1, and one end of the grounding pin 13 is inserted in the plug-in mounting hole 102, so that the grounding pin 13 can be inserted in British socket with the second plug pins 113.

To sum up, in specific use of the present invention, when the first plug pins 112 or the second plug pins 113 of plug 11 are extended out of the first outer casing 1 by pushing the push button 111, the first outer casing 1 is turned 90° against the second outer casing 2, so that the first plug pins 112 or the second plug pins 113 in the first outer casing 1 can be inserted in the external socket, the plug can be used by turning the first outer casing to change angle, it is convenient to use, and the present invention is smaller and flatter to be carried with and used.

Embodiment 2

The differences between the structure of the Embodiment 2 and the structure of the Embodiment 1 are the assembly methods of the first outer casing 1 and the second outer casing 2 and the mounting frame of grounding pin.

Figure 9:
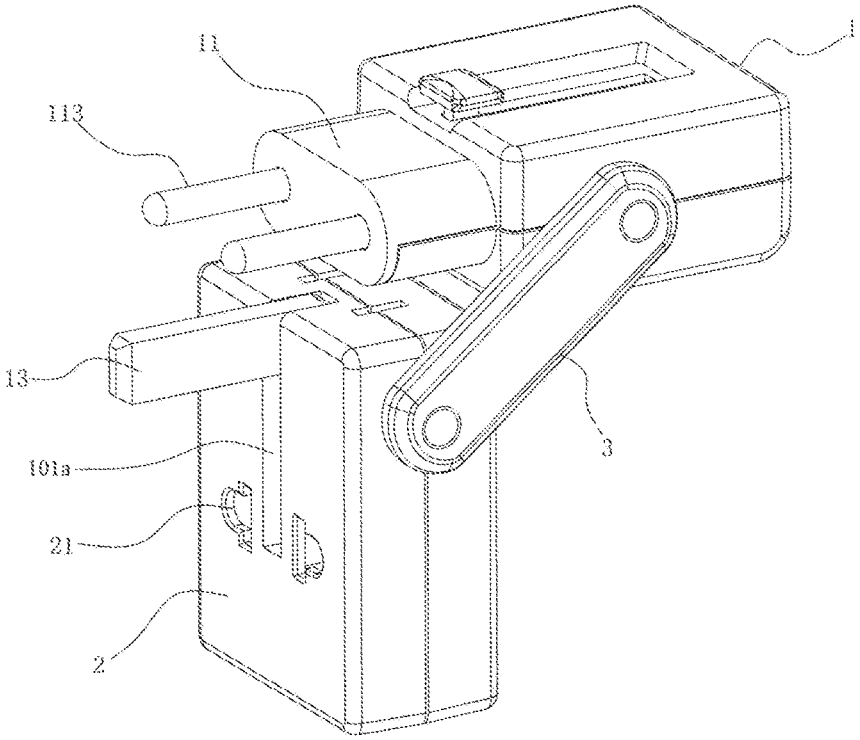
FIG. 9 is a structural representation of Embodiment 2 of the present invention (unfolded mode)
Figure 10:
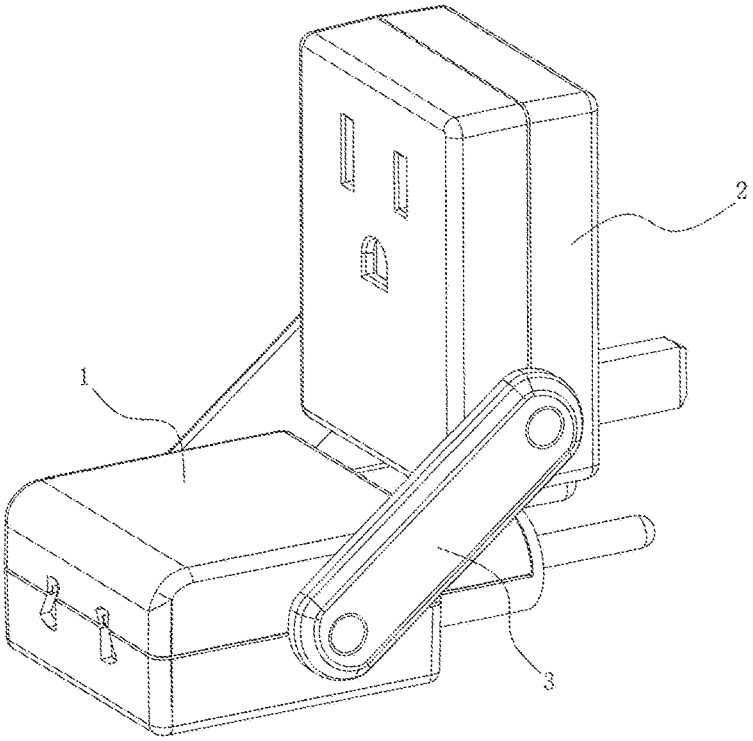
FIG. 10 is a structural representation of Embodiment 2 of the present invention from another viewing angle (unfolded mode)

To be specific, as shown in FIGS. 9 and 10, one or more than one connecting rod 3 is located between the second outer casing 2 and the first outer casing 1. Both ends of the connecting rod 3 grip the shaft or shaft hole of the second outer casing 2 and the first outer casing 1 respectively, so that both ends of the connecting rod 3 can rotate against the second outer casing 2 and the first outer casing 1, and the first outer casing 1 can rotate against the second outer casing 2.

As shown in FIGS. 9 and 10, the second outer casing 2 is provided with a first holding slot 101*a*. One end of the grounding pin 13 is rotatablely mounted in the first holding slot 101*a*, so that the grounding pin 13 can be turned 90° against the second outer casing 2 and used with the first plug pins 112 or the second plug pins 11 of plug 11. The grounding pin 13 can be stored in the first holding slot 101*a*, it is very convenient.

The structure of the Embodiment 2 is identical with the structure of the Embodiment 1, not to be described again.

The differences between the structure of the embodiment 3 and the structure of the Embodiment 1 are the assembly methods of the first outer casing 1 and the second outer casing 2 and the mounting frame of grounding pin.

Figure 11:
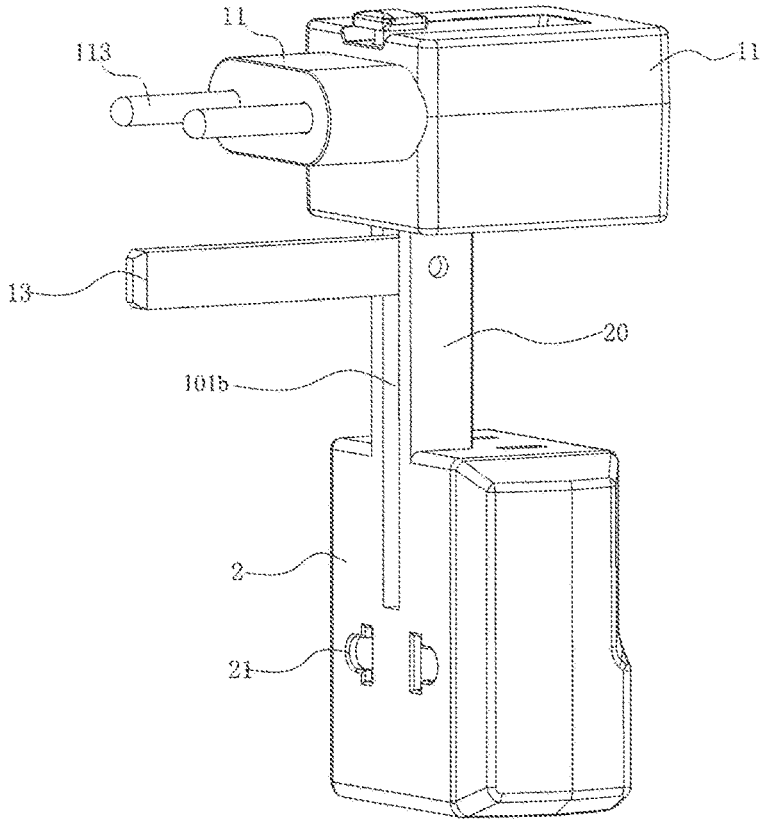
FIG. 11 is a structural representation of Embodiment 3 of the present invention (unfolded mode)
Figure 12:
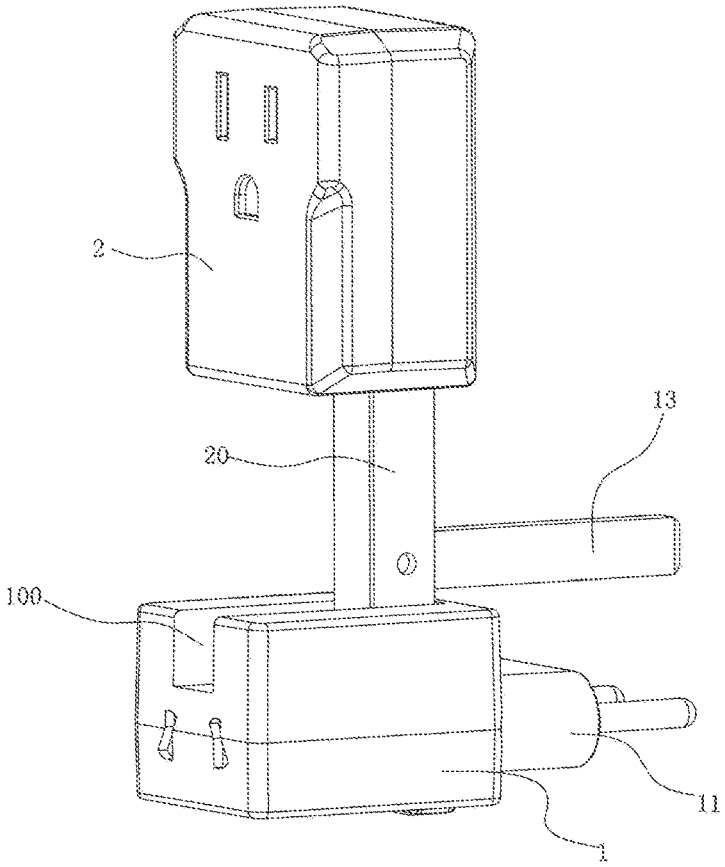
FIG. 12 is a structural representation of Embodiment 3 of the present invention from another viewing angle (unfolded mode).

To be specific, as shown in FIGS. 11 and 12, the second outer casing 2 is provided with an extension arm 20. The extension arm 20 is located in the middle of upper end of the second outer casing 2. The extension arm 20 is provided with a grounding pin 13 which can be unfolded 900 against the extension arm 20 or folded. The upper end of the extension arm 20 is connected to the shaft and shaft hole, and the first outer casing 1 is provided with a holding slot 100 for holding the extension arm 20. The first outer casing 1 can be turned 90° against the extension arm 20 before use. The extension arm 20 is embedded in the holding slot 100 of the first outer casing 1 after use, so that the extension arm 20 is stored in the holding slot 100, it is very convenient.

As shown in FIGS. 9 and 10, the extension arm 20 is provided with a second holding slot 101*b*, the second holding slot 101*b* extends to the second outer casing 2. One end of the grounding pin 13 is rotatablely mounted in the second holding slot 101*b*, so that the grounding pin 13 can be turned 90° against the second outer casing 2 and used with the first plug pins 112 or the second plug pins 11 of plug 11. The grounding pin 13 can be stored in the second holding slot 101*b* as required, it is very convenient.

The structure of the Embodiment 3 is identical with the structure of the Embodiment 1, not to be described anymore.

The above only describes some exemplary embodiments of the present invention. Those having ordinary skills in the art may also make many modifications and improvements without departing from the conception of the invention, which shall all fall within the protection scope of the invention.

We claim:

1. A multi-specification plug adapter, comprising:

a first outer casing (1) and a second outer casing (2) mounted to each other; the second outer casing (2) including one or more than one socket holes (21); the first outer casing (1) including one or more than one sliding plugs (11) disposed therein; one or more than one sliding plus (11) is provided with a push button (111), and the push button (111) is disposed outside the first outer casing (1); one or more than one sliding plugs (11) having first plug pins (112) and second plug pins (113) of different specifications at both ends; the first plug pins (112) or the second plug pins (113) of one or more than one sliding plugs (11) can be extended outside the first outer casing (1) by pushing the push button (111);

wherein the second outer casing (2) and the first outer casing (1) have one or more sets of corresponding rotating shafts (23) and shaft holes (10); the first outer casing (1) is rotatable relative to the second outer casing (2) through the rotating shaft (23);

wherein the second outer casing (2) includes second bus bars (24) electrically connected to conductive sheets (22): the first outer casing (1) includes first bus bars (12) electrically connected to one or more than one sliding plugs (1): the second bus bars (24) and the first bus bars (12) are electrically conducted through the shaft (23).

2. The multi-specification plug adapter according to claim 1, wherein the second outer casing (2) is formed with an extension arm (20) on both sides; the extension arm (20) is formed with the shaft (23) or the shaft hole (10).

3. The multi-specification plug adapter according to claim 1, wherein the second housing (2) includes a corresponding first holding slot (101*a*) at the end for accepting the first plug pins (112) or the second plug pins (113).

4. The multi-specification plug adapter according to claim 3, wherein the first outer casing (1) includes a removable grounding pin (13) from the slot on the outer surface; the first outer casing (1) further includes a plug-in mounting hole for detaching the grounding pin (13) on the outer surface.

5. The multi-specification plug adapter according to claim 1, includes DC outlet.

6. The multi-specification plug adapter according to claim 1, wherein the first outer casing (1) includes slidable inclined shutters (15) and accesses (14) at the end, the slidable inclined shutters (15) are built in the accesses (14) inside, when pushing out the first plug pins (112) or the second plug pins (113), the slidable inclined shutter (15) is pushed by plug pin.

* * * * *